US011684190B2

(12) United States Patent
Hong-Lin

(10) Patent No.: US 11,684,190 B2
(45) Date of Patent: Jun. 27, 2023

(54) STRUCTURE OF STRAW AND A SET COMPRISING SUCH A STRAW

(71) Applicant: Yen Hong-Lin, Taoyuan (TW)

(72) Inventor: Yen Hong-Lin, Taoyuan (TW)

(73) Assignee: Yen Hong-Lin, Taoyuan (TW)

( * ) Notice: Subject to any disclaimer, the term of this patent is extended or adjusted under 35 U.S.C. 154(b) by 173 days.

(21) Appl. No.: 17/146,505

(22) Filed: Jan. 12, 2021

(65) Prior Publication Data

US 2021/0212490 A1 Jul. 15, 2021

(30) Foreign Application Priority Data

Jan. 14, 2020 (TW) ..... 109200534
Mar. 31, 2020 (TW) ..... 109203772

(51) Int. Cl.
*A47G 21/18* (2006.01)

(52) U.S. Cl.
CPC ..... *A47G 21/18* (2013.01)

(58) Field of Classification Search
CPC ..... A63H 33/086; B29C 65/78; B31B 50/42; F16L 25/12; F16L 59/02–22; H02G 15/1813; H02G 3/0418; H02G 9/065; B65D 63/1063; F16B 2/08
See application file for complete search history.

(56) References Cited

U.S. PATENT DOCUMENTS

2019/0338882 A1* 11/2019 Fukuda ..... H02G 3/0481

FOREIGN PATENT DOCUMENTS

WO WO-2020054988 A1 * 3/2020 ..... A47G 21/186

* cited by examiner

*Primary Examiner* — Tuongminh N Pham
(74) *Attorney, Agent, or Firm* — Amin, Turocy & Watson, LLP

(57) ABSTRACT

The present inventive concept discloses an improved structure of a straw comprising a tubular body and a connecting member. The tubular body has a first end, a second end and openings, and each of the openings is formed at the first end and the second end, respectively. The tubular body comprises a tube wall disposed between the first end and the second end. The connecting member is disposed at the tube wall, wherein a thickness of the connecting member is thicker than a thickness of the tube wall. The connecting member comprises a first fastener and a second fastener corresponding to the first fastener, and the first fastener is coupled with the second fastener openably and closably.

24 Claims, 7 Drawing Sheets

STRUCTURE OF STRAW AND A SET COMPRISING SUCH A STRAW

RELATED APPLICATIONS

The present application claims the priorities of Taiwan Application Nos. 109200534 and 109203772, filed on Jan. 14, 2020 and Mar. 31, 2020, respectively, the disclosures of which are hereby incorporated by reference herein in its entirety.

BACKGROUND OF THE INVENTION

1. Field of the Invention

The present disclosure generally relates to an improved structure of straw, particularly, to an improved structure of straw with a connecting member.

2. Description of the Related Art

In order to help conserve and protect the environment, new policies are announced to reduce the usage of plastic products, including plastic bags, plastic straws, etc.

Alternatives to plastic straws, including paper straws, or straws made of other fibers, are single-use straws. Therefore, reusable straws made of glass, stainless steel, or silicone are anticipated.

However, users may concern that it is not easy to clean those conventional reusable straws or to determine they are clean or not. Taiwanese Utility Patent No. M576836 disclosed an environmentally friendly straw which can be disassembled. The straw may be taken apart as flattened mode, then cleaned and reassembled back to straw mode, but the straw of Taiwanese Utility Patent No. M576836 is not easy to be reassembled.

SUMMARY OF THE INVENTION

In light of solving the foregoing problems of the prior art, the present inventive concept provides an improved structure of a straw with a connecting structure which is easy to use.

The improved structure of a straw of the present inventive concept comprises a tubular body and a connecting member. The tubular body has a first end, a second end and openings, and each of the openings is formed at the first end and the second end, respectively; wherein the tubular body comprises a tube wall, which is disposed between the first end and the second end.

The connecting member is disposed at the tube wall, wherein a thickness of the connecting member is thicker than a thickness of the tube wall; wherein the connecting member comprises a first fastener and a second fastener corresponding to the first fastener, and wherein the first fastener is coupled with the second fastener openably and closably.

In an embodiment of the present inventive concept, a length of the connecting member substantially equals to a length of the tube wall.

In an embodiment of the present inventive concept, the tube wall has an inner surface and an outer surface corresponding to the inner surface, wherein one side of the connecting member near the inner surface is configured to substantially align with the inner surface, so that the connecting member protrudes outwardly from the outer surface.

In an embodiment of the present inventive concept, the tubular body and the connecting member are formed in one piece.

In an embodiment of the present inventive concept, the tube wall has a first side and a second side corresponding to the first side, and wherein the first fastener is disposed at the first side and extends from the first end to the second end; and the second fastener is disposed at the second side and extends from the first end to the second end.

In an embodiment of the present inventive concept, the first fastener comprises a groove, and the groove is disposed at and along the first fastener; wherein the groove has a slit toward the second fastener.

In an embodiment of the present inventive concept, the second fastener comprises a protruding member, the protruding member is disposed at and along the second fastener; wherein the protruding member is toward the first fastener.

In an embodiment of the present inventive concept, the first fastener further comprises two auxiliary members, and each of the auxiliary members is disposed at each side of the slit along the first fastener; wherein each of the auxiliary members extends toward the second fastener.

In an embodiment of the present inventive concept, the protruding member comprises a first protruding part and a second protruding part, wherein the first protruding part is disposed along the second fastener and the second protruding part is disposed on the first protruding part along the second fastener, and wherein the first protruding part substantially corresponds to the auxiliary members and the second protruding part substantially corresponds to the groove.

In an embodiment of the present inventive concept, the second protruding part has an expanding part, wherein a width of the expanding part is larger than a width of the first protruding part.

In an embodiment of the present inventive concept, the width of the expanding part is not larger than a width of the connecting member.

In an embodiment of the present inventive concept, the two auxiliary member forms a curved structure extending from the inner surface and the outer surface of the tube wall, and a hook is formed at an outward end of each of the two auxiliary members and a hook point of the hook faces the groove.

In an embodiment of the present inventive concept, a spacing between the two hook point is smaller than the width of the expanding part but not smaller than the width of the first protruding part.

The present inventive concept further provides a set comprising a first straw with the improved structure of a straw of the present inventive concept and an assembly tool.

The assembly tool comprises a body, a first through hole and a second through hole. The first through hole is disposed through the body, wherein the first through hole has a shape corresponding to an outer contour of the tubular body of the first straw; and the second through hole is disposed through the body, wherein the second through hole is beside the first through hole and integrates to the first through hole, and wherein the second through hole has a shape corresponding to an outer contour of the connecting member of the first straw.

In an embodiment of the present inventive concept, the first through hole has a first diameter substantially the same as an inside diameter of the tubular body.

In an embodiment of the present inventive concept, the second through hole has a second diameter substantially the same as a width of the connecting member when the first fastener is coupled with the second fastener.

In an embodiment of the present inventive concept, the assembly tool further comprises a storage case, wherein the storage case is connected to the body.

In another embodiment of the present inventive concept, the assembly tool further comprises a third through hole, a fourth through hole and a spacing part. The third through hole is disposed through the body. The fourth through hole is disposed through the body, wherein the fourth through hole is beside the third through hole and integrates to the third through hole; and the spacing part is disposed between the integrated first through hole and second through hole and the integrated third through hole and fourth through hole.

In an embodiment of the present inventive concept, the third through hole has a third diameter smaller or larger than the first diameter, or the fourth through hole has a fourth diameter smaller or larger than the second diameter.

The set of the present inventive concept further comprises a second straw with the improved structure of a straw of the present inventive concept, wherein the third through hole has a shape corresponding to an outer contour of the tubular body of the second straw; and the fourth through hole has a shape corresponding to an outer contour of the connecting member of the second straw.

In an embodiment of the present inventive concept, the third through hole has a third diameter smaller or larger than the first diameter, or the fourth through hole has a fourth diameter smaller or larger than the second diameter.

In another embodiment of the present inventive concept, the assembly tool further comprises a fifth through hole and a spacing part. The fifth through hole is disposed through the body; wherein the fifth through hole is beside the second through hole and integrates to the second through hole and the spacing part is disposed between the first through hole and the fifth through hole.

In an embodiment of the present inventive concept, the fifth through hole has a fifth diameter smaller or larger than the first diameter.

The set of the present inventive concept further comprises a second straw with the improved structure of a straw of the present inventive concept, wherein the fifth through hole has a shape corresponding to an outer contour of the tubular body of the second straw; and the second through hole has a shape corresponding to an outer contour of the connecting member of the second straw.

In an embodiment of the present inventive concept, the fifth through hole has a fifth diameter smaller or larger than the first diameter.

Compared to the conventional straws, the present inventive concept provides an improved structure of a straw comprising a tubular body and a connecting member, wherein the connecting member is disposed at the tube wall and the thickness of the connecting member is larger than that of the tube wall. Consequently, the thicker connecting member enables the first fastener being coupled with the second fastener openably and closably more easily. The assembly tool of the present inventive concept has a structure corresponding to the improved structure of a straw of the present inventive concept, which enables users to couple the first fastener with the second fastener of the straw in a short time. The set comprising the straw with the improved structure of a straw of the present inventive concept and the assembly tool improve efficiency and convenience for user to use a reusable straw.

DETAILED DESCRIPTION

The present inventive concept is described by the following specific embodiments. Those with ordinary skills in the arts can readily understand other advantages and functions of the present inventive concept after reading the disclosure of this specification. Any changes or adjustments made to their relative relationships, without modifying the substantial technical contents, are also to be construed as within the range implementable by the present inventive concept.

Moreover, the word "exemplary" or "embodiment" is used herein to mean serving as an example, instance, or illustration. Any aspect or design described herein as exemplary or an embodiment is not necessarily to be construed as preferred or advantageous over other aspects or designs. Rather, use of the word "exemplary" or "embodiment" is intended to present concepts and techniques in a concrete fashion.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

Figure 1:
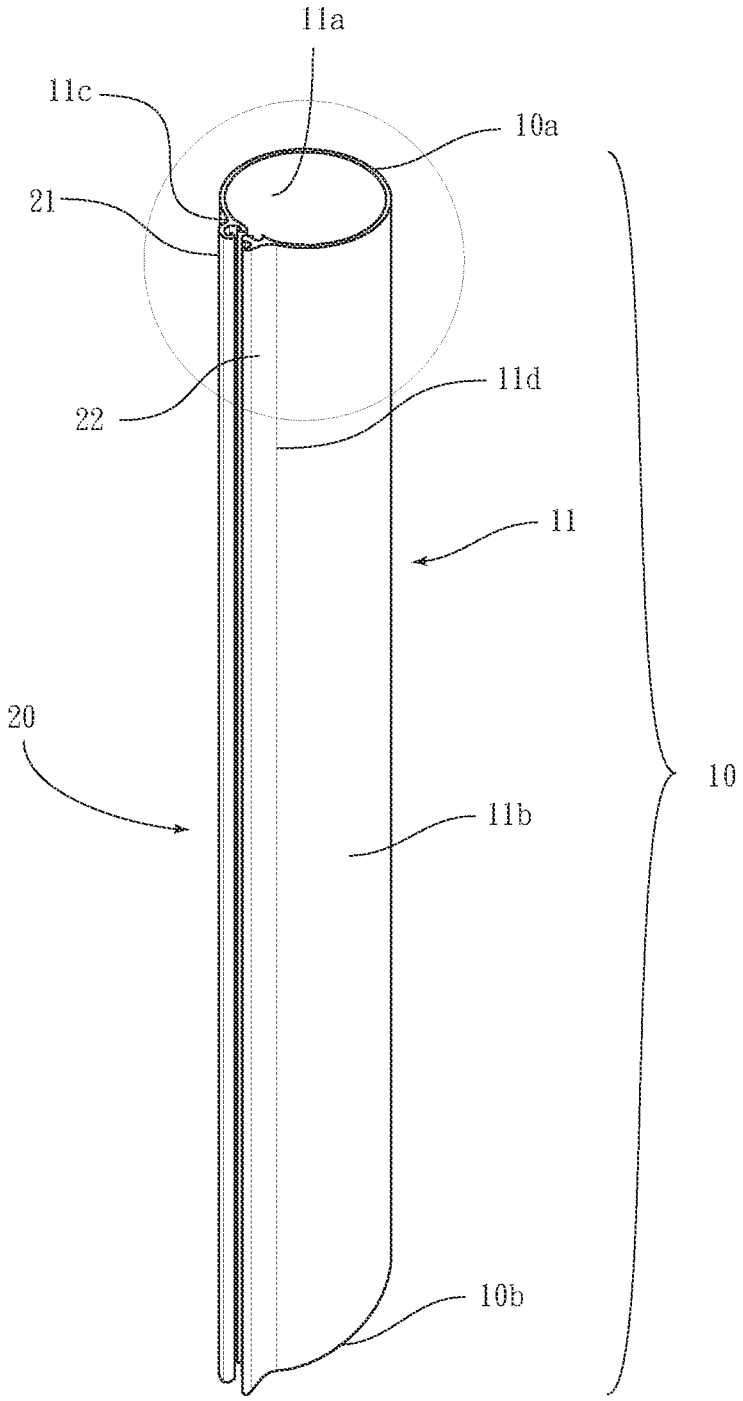
FIG. 1 is a structure schematic view of an improved structure of a straw according to the present inventive concept.
Figure 2:
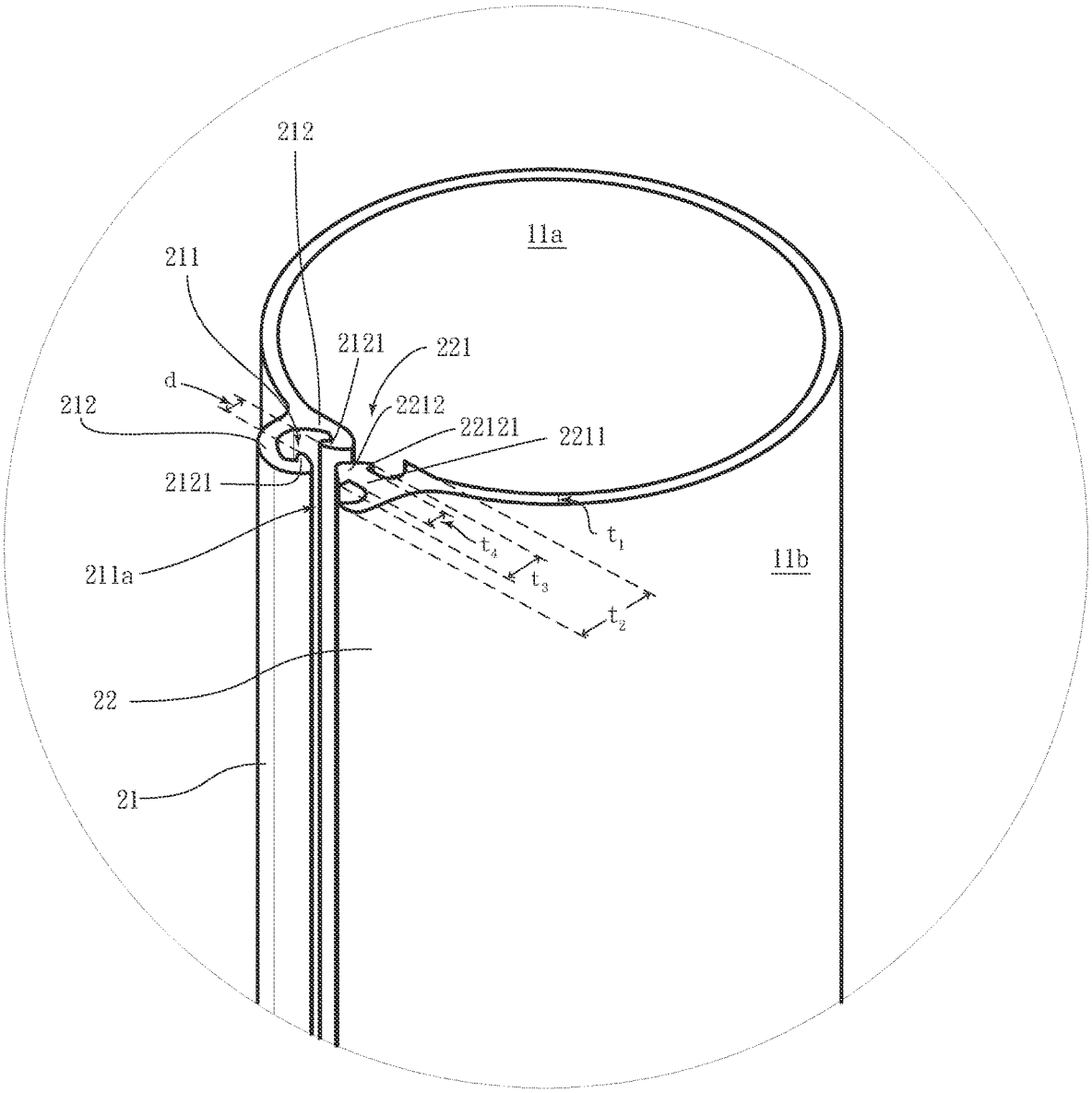
FIG. 2 is an enlarged view of a portion of FIG. 1 and illustrating the connecting member of the improved structure of a straw according to the present inventive concept.
Figure 3:
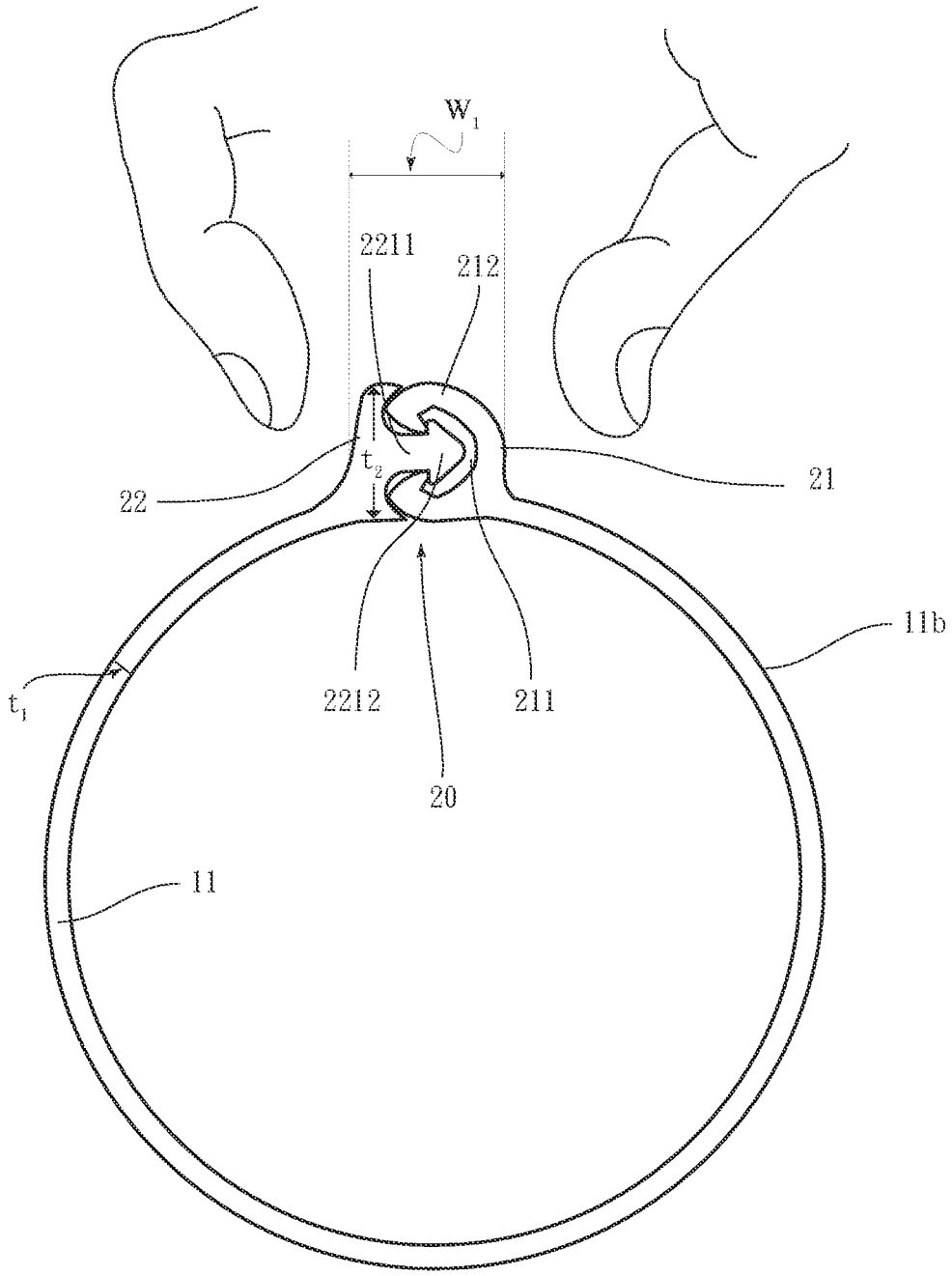
FIG. 3 is a top view illustrating the improved structure of a straw being in use according to the present inventive concept.

Please refer to FIGS. 1 to 3. FIG. 1 is a structure schematic view of an improved structure of a straw according to the present inventive concept; FIG. 2 is an enlarged view of a portion of FIG. 1 and illustrating the connecting member of the improved structure of a straw according to the present inventive concept; and FIG. 3 is a top view illustrating the improved structure of a straw being in use according to the present inventive concept. The present inventive concept provides an improved structure of a straw which comprises a tubular body 10 and a connecting member 20. The tubular body 10 may have a first end 10*a*, a second end 10*b* and openings, and each of the openings may be formed at the first end 10*a* and the second end 10*b*, respectively. The tubular body 10 may further comprise a tube wall 11. The tube wall 11 may be disposed between the first end 10*a* and the second end 10*b*.

The may be disposed at the tube wall 11, wherein a thickness $t_2$ of the connecting member 20 may be thicker than a thickness $t_1$ of the tube wall 11. The connecting member 20 may further comprise a first fastener 21 and a second fastener 22 corresponding to the first fastener 21, and wherein the first fastener 21 may be coupled with the second fastener 22 openably and closably.

In one embodiment of the present inventive concept, a length of the connecting member 20 may substantially equal to a length of the tube wall 11.

In one embodiment of the present inventive concept, the tube wall 11 may have an inner surface 11*a* and an outer surface 11*b* corresponding to the inner surface 11*a*, wherein one side of the connecting member 20 near the inner surface may be configured to substantially align with the inner surface 11*a*, so that the connecting member 20 may protrude outwardly from the outer surface 11*b*, which is shown in FIG. 3.

In one embodiment of the present inventive concept, the tubular body 10 and the connecting member 20 may be formed in one piece.

In an embodiment of the present inventive concept, the tube wall 11 may have a first side 11*c* and a second side 11*d* corresponding to the first side 11*c*, and wherein the first fastener 21 may be disposed at the first side 11*c* and extend along from the first end 10*a* to the second end 10*b*; and the second fastener 22 may be disposed at the second side 11*d* and extend along from the first end 10*a* to the second end 10*b*.

In an embodiment of the present inventive concept, the first fastener 21 may comprise a groove 211, and the groove 211 may be disposed at and along the first fastener 21; wherein the groove 211 may have a slit 211*a* toward the second fastener 22.

In an embodiment of the present inventive concept, the second fastener 22 may comprise a protruding member 221, the protruding member 221 may be disposed at and along the second fastener 22; wherein the protruding member 221 may be toward the first fastener 21.

In an embodiment of the present inventive concept, the first fastener 21 may further comprise two auxiliary members 212, and each of the auxiliary members 212 may be disposed at each side of the slit 211*a* along the first fastener 21; wherein each of the auxiliary members 212 may extend toward the second fastener 22.

In an embodiment of the present inventive concept, the protruding member 221 may comprise a first protruding part 2211 and a second protruding part 2212, wherein the first protruding part 2211 may be disposed along the second fastener 22 and the second protruding part 2212 may be disposed on the first protruding part 2211 along the second fastener 22, and wherein the first protruding part 2211 may substantially correspond to the auxiliary members 212 and the second protruding part 2212 may substantially correspond to the groove 211. Preferably, the spacing between the two auxiliary members 212 may be equal to or less than the width of the first protruding part 2211.

Please refer to FIG. 2. In an embodiment of the present inventive concept, the second protruding part 2212 may have an expanding part 22121, wherein a width $t_3$ of the expanding part 22121 may be larger than a width $t_4$ of the first protruding part 2211.

In an embodiment of the present inventive concept, the width $t_3$ of the expanding part 22121 may be not larger than, e.g. less than or equal to, a width $t_2$ of the connecting member 20.

In an embodiment of the present inventive concept, the two auxiliary member 212 may form a curved structure extending from the inner surface 11*a* and the outer surface 11*b* of the tube wall 11, and a hook 2121 may be formed at an outward end of each of the two auxiliary members 212 and a hook point of the hook 2121 may face the groove 211.

In an embodiment of the present inventive concept, a spacing d between the two hook points may be smaller or less than the width $t_3$ of the expanding part 22121, but not smaller than, e.g. larger than or equal to the width Li of the first protruding part 2211.

Please refer to FIGS. 2 and 3. FIG. 3 is a top view illustrating the improved structure of a straw being in use according to the present inventive concept. According to the embodiments of the present inventive concept, when the first fastener 21 is coupled with the second fastener 22, the second protruding part 2212 of the protruding member 221 may be inserted into the groove 211. The auxiliary members 212 may engage the first protruding part 2211. According to a preferable embodiment, each of the auxiliary members 212 may further comprise a hook 2121 and the second protruding part 2212 may have an expanding part 22121. The width $t_3$ of the expanding part 22121 may be larger than the width $t_4$ of the first protruding part 2211 and a width of the second protruding part 2212 may be tapered towards the groove 211. The distance between the spacing d may be varied. Distance between the spacing d between the two auxiliary members 212 may be measured between the surfaces of each auxiliary members 212 facing each other. The shortest distance between the spacing d between the two auxiliary members 212 may be larger than or equal to the width $t_4$ of the first protruding part 2211, and the shortest distance between the spacing d between the two auxiliary members 212 may be equal to or less than the width $t_3$ of the expanding part 22121, which enables the hook 2121 to fit against the second protruding part 2212 and/or the first protruding part 2211 more closely. By doing so, the first fastener 21 and the second fastener 22 may be engaged more tightly.

In this embodiment, the width $t_2$ of the connecting member 20 may be larger than the width $t_1$ of the tube wall 11. When users wants to engage the first fastener 21 and the second fastener 22, their fingers may press against the portion of the connecting member 20 which stands out the outer surface 11*b* in order to engage the first fastener 21 and the second fastener 22.

Figure 4:
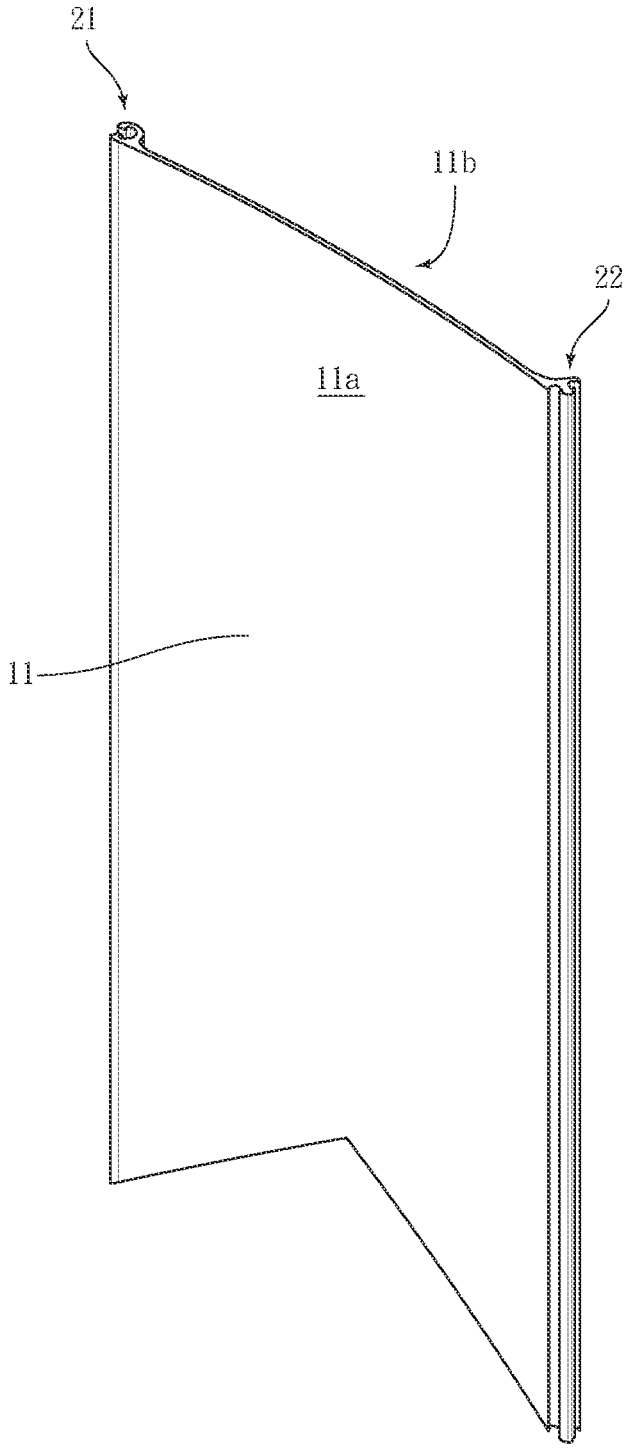
FIG. 4 is an another view illustrating the improved structure of a straw being in use according to the present inventive concept.

Please refer to FIG. 4. FIG. 4 is an another view illustrating the improved structure of a straw being in use according to the present inventive concept. According to the embodiment of the present inventive concept, the improved structure of a straw may be made of flexible materials. When the straw is not in use, users may detach the first fastener 21 from the second fastener 22, open the straw and flatten the tube wall 11. By doing so, users may clean the inner surface 11*a* of the tube wall 11.

The present inventive concept further provides a set comprising a first straw 1A with the improved structure of a straw of the present inventive concept and an assembly tool 30.

Figure 5:
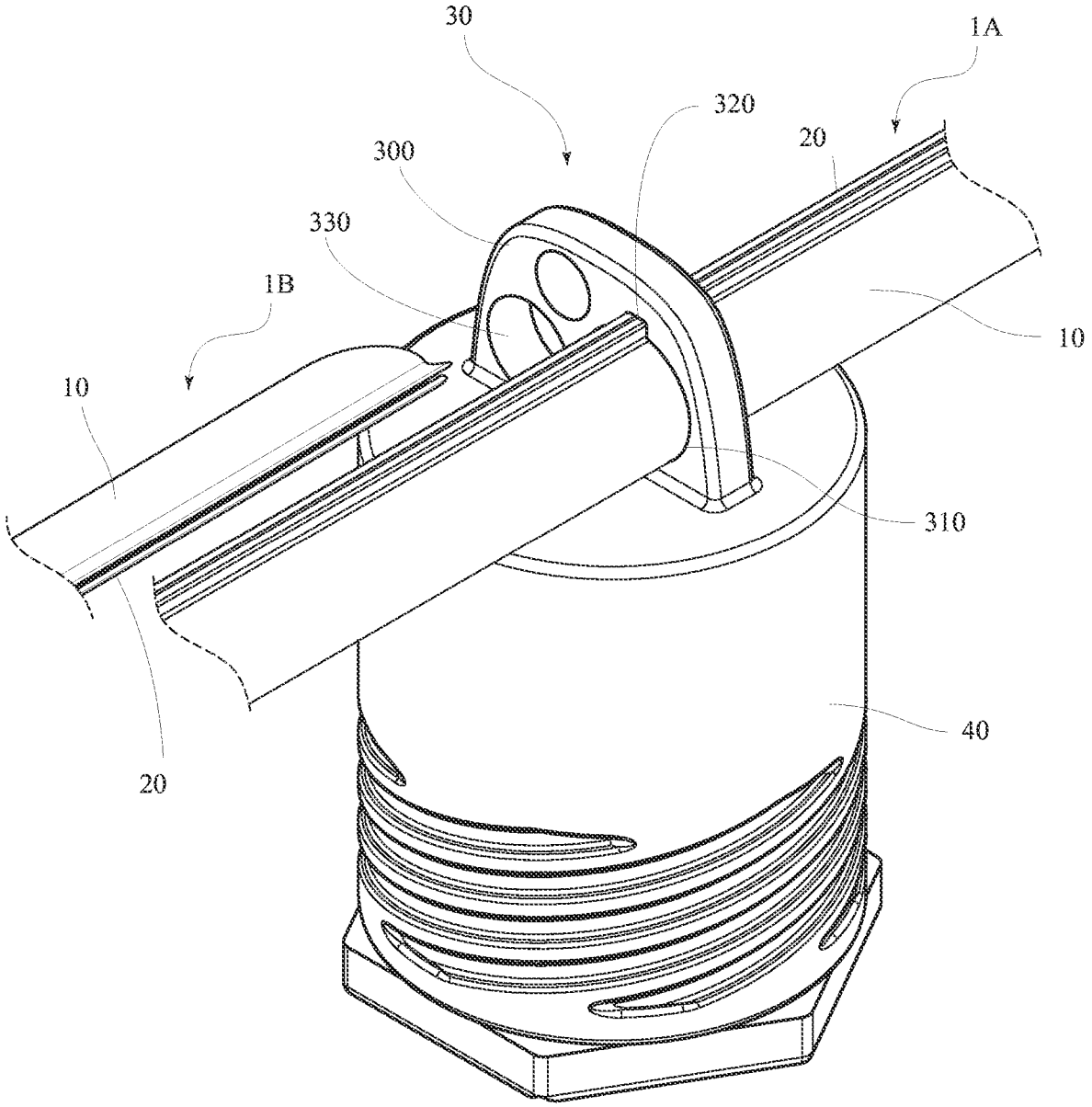
FIG. 5 is a structure schematic view of a set according to the present inventive concept.
Figure 6:
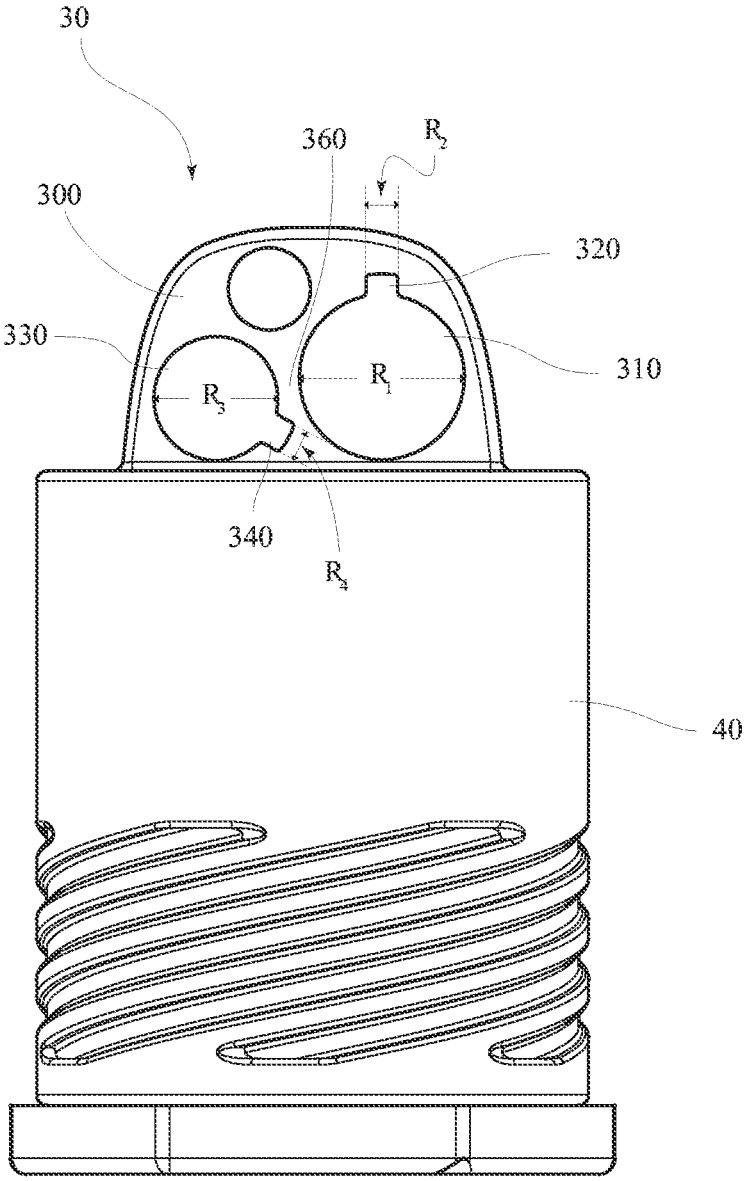
FIG. 6 is a structure schematic view of an assembly tool 30 according to an embodiment of the present inventive concept.

Please refer to FIGS. 5 and 6. FIG. 5 is structure schematic view of a set according to the present inventive concept and FIG. 6 is structure schematic view of an assembly tool 30 according to an embodiment of the present inventive concept.

The assembly tool 30 may comprise a body 300, a first through hole 310 and a second through hole 320. The first through hole 310 may be disposed through the body 300, wherein the first through hole 310 may have a shape corresponding to an outer contour of the tubular body 10 of the first straw 1A; and the second through hole 320 may be disposed through the body 300, wherein the second through hole 320 may be beside the first through hole 310 and integrates to the first through hole 310, and wherein the second through hole 320 may have a shape corresponding to an outer contour of the connecting member 20 of the first straw 1A.

In an embodiment of the present inventive concept, the first through hole 310 may have a first diameter $R_1$ substantially the same as an inside diameter $t_1$ of the tubular body 10.

In an embodiment of the present inventive concept, the second through hole 320 may have a second diameter $R_2$ substantially the same as a width $W_1$ of the connecting member 20 when the first fastener 21 is coupled with the second fastener 22 (Please refer to FIG. 3).

Please refer to FIG. 5. According to one embodiment of the present inventive concept, when the first straw 1A passes the body 300 through the first through hole 310 and the second through hole 320, the first through hole 310 may be substantially adjacent to the tube body 10 and the second through hole 320 may be substantially adjacent to the connecting member 20. Therefore, when the first straw 1A passes through the first through hole 310 and the second through hole 320, the edge of the second through hole 320 may be closely against the connecting member 20. The structure of the second through hole 320 enables the first fastener 21 and the second fastener 22 to engage to each other to close the connecting member 20.

In an embodiment of the present inventive concept, the assembly tool 30 may further comprise a storage case 40, wherein the storage case 40 may be connected to the body 30.

According to one embodiment of the present inventive concept, the storage case 40 is used to store the straw 1A.

Please refer to In another embodiment of the present inventive concept, the assembly tool 30 may further comprise a third through hole 330, a fourth through hole 340 and a spacing part 360.

The third through hole 330 may be disposed through the body 300. The fourth through hole 340 may be disposed through the body 300.

The fourth through hole 340 may be beside the third through hole 330 and integrates to the third through hole 330; and the spacing part 360 may be disposed between the integrated first through hole 310 and second through hole 320 and the integrated third through hole 330 and fourth through hole 340.

In an embodiment of the present inventive concept, the third through hole 330 may have a third diameter $R_3$ which is smaller or larger than or substantially equals to the first diameter $R_1$ of the first through hole 310, or the fourth through hole 340 may have a fourth diameter $R_4$ which is smaller or larger than or substantially equals to the second diameter $R_2$ of the second through hole 320.

In a preferable embodiment of the present inventive concept, the third diameter $R_3$ of the third through hole 330 may be substantially smaller or larger than the first diameter $R_1$ of the first through hole 310 and the fourth diameter $R_4$ of the fourth through hole 340 may be substantially smaller or larger than or equal to the second diameter $R_2$ of the second through hole 320.

The set of the present inventive concept may further comprise a second straw 1B with the improved structure of a straw of the present inventive concept (as shown in FIG. 5).

The third through hole has a shape corresponding to an outer contour of the tubular body of the second straw; and the fourth through hole has a shape corresponding to an outer contour of the connecting member of the second straw.

The first through hole 310 may have a shape corresponding to an outer contour of the tubular body 10 of the first straw 1A and wherein the second through hole 320 may have a shape corresponding to an outer contour of the connecting member 20 of the first straw 1A.

In this embodiment, the third through hole 330 may have a shape corresponding to an outer contour of the tubular body 10 of the second straw 1B and wherein the fourth through hole 340 may have a shape corresponding to an outer contour of the connecting member 20 of the second straw 1B.

In an embodiment of the present inventive concept, the third through hole 330 may have a third diameter $R_3$ which is smaller or larger than or substantially equals to the first diameter $R_1$ of the first through hole 310, or the fourth through hole 340 may have a fourth diameter $R_4$ which is smaller or larger than or substantially equals to the second diameter $R_2$ of the second through hole 320.

In a preferable embodiment of the present inventive concept, the third diameter $R_3$ of the third through hole 330 may be substantially smaller or larger than the first diameter $R_1$ of the first through hole 310 and the fourth diameter $R_4$ of the fourth through hole 340 may be substantially smaller or larger than the second diameter $R_2$ of the second through hole 320. For example, but not limited that the third diameter $R_3$ of the third through hole 330 may be substantially smaller than the first diameter $R_1$ of the first through hole 310 and the fourth diameter $R_4$ of the fourth through hole 340 may substantially equal to the second diameter $R_2$ of the second through hole 320.

Figure 7:
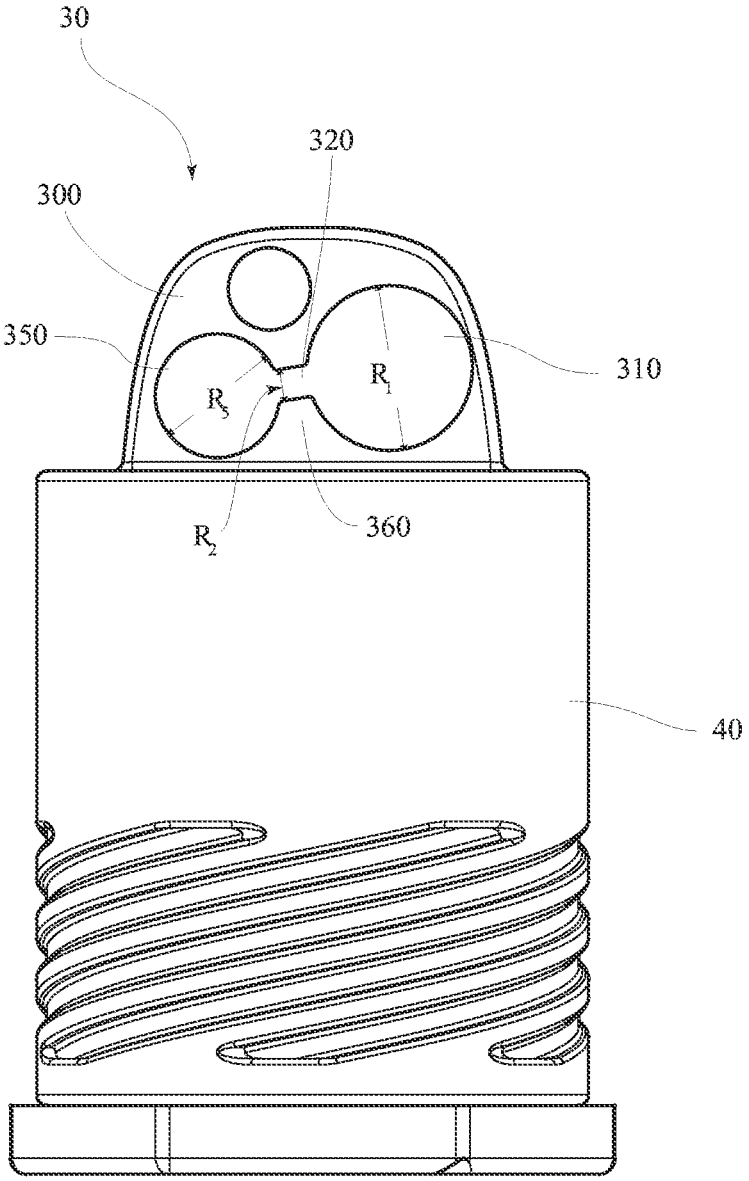
FIG. 7 is a structure schematic view of an assembly tool according to an another embodiment of the present inventive concept.

Please refer to FIG. 7. FIG. 7 is a structure schematic view of an assembly tool according to an another embodiment of the present inventive concept. The assembly tool 30 may further comprise a fifth through hole 350 and a spacing part 360. The fifth through hole 350 may be disposed through the body 300; wherein the fifth through hole 350 may be beside the second through hole 320 and integrates to the second through hole 320 and the spacing part 360 may be disposed between the first through hole 310 and the fifth through hole 350.

In an embodiment of the present inventive concept, the fifth through hole 350 may have a fifth diameter $R_5$ which is smaller or larger than the first diameter $R_1$ of the first through hole 310.

In an embodiment, the set of the present inventive concept may further comprise a second straw 1B with the improved structure of a straw of the present inventive concept (as shown in FIG. 5). The first through hole 310 may have a shape corresponding to an outer contour of the tubular body 10 of the first straw 1A and wherein the second through hole 320 may have a shape corresponding to an outer contour of the connecting member 20 of the first straw 1A. Besides, the fifth through hole 350 may have a shape corresponding to an outer contour of the tubular body 10 of the second straw 1B and wherein the second through hole 320 may have a shape corresponding to an outer contour of the connecting member 20 of the second straw 1B.

In an embodiment of the present inventive concept, the fifth through hole 350 may have a fifth diameter $R_5$ which is smaller or larger than the first diameter $R_1$ of the first through hole 310.

In a preferable embodiment of the present inventive concept, the fifth diameter $R_5$ of the fifth through hole 350 may be substantially smaller than the first diameter $R_1$ of the first through hole 310, but not limited.

In summary, the present inventive concept provides an improved structure of a straw. The connecting member thereof is protruding out of the outer surface of the tube wall, so the users may press the protruding connecting member to make the first fastener coupling with the second fastener easily. Besides, the corresponding first fastener and the second fastener may fasten to each other securedly.

Besides, the present inventive concept further provides a set comprising a first straw with the improved structure of a straw of the present inventive concept and an assembly tool. The assembly tool has integrated first through hole and second through hole may fit the contour of the improved structure of a straw of the present inventive concept properly. Accordingly, when the straws pass through the integrated first through hole and second through hole, the second through hole enables the first fastener engaged with the second fastener accurately and fast to close the connecting member.

Consequently, the improved structure of a straw and the set of the present inventive concept is not only easy-to-clean but also more easy-to-use.

The foregoing descriptions of the detailed embodiments are only illustrated to disclose the features and functions of the present inventive concept and not restrictive of the scope of the present inventive concept. It should be understood to those in the art that all modifications and variations according to the spirit and principle in the disclosure of the present inventive concept should fall within the scope of the appended claims.

What is claimed is:

1. A set comprising a first straw with an improved structure of a straw and an assembly tool, wherein the improved structure of the straw, comprising:

a tubular body having a first end, a second end and openings, and each of the openings is formed at the first end and the second end, respectively; wherein the tubular body comprises: a tube wall, which is disposed between the first end and the second end; and a connecting member disposed at the tube wall, wherein a thickness of the connecting member is thicker than a thickness of the tube wall; wherein the connecting member comprises: a first fastener and a second fastener corresponding to the first fastener, and wherein the first fastener is coupled with the second fastener openably and closably;

the assembly tool comprises: a body; a first through hole, disposed through the body, wherein the first through hole has a shape corresponding to an outer contour of the tubular body of the first straw; a first notch, disposed through the body, wherein the first notch is beside the first through hole and integrates to the first through hole, and wherein the first notch has a shape corresponding to an outer contour of the connecting member of the first straw;

a second through hole, disposed through the body;

a second notch, disposed through the body, wherein the second notch is beside the second through hole and integrates to the second through hole; and a spacing part, disposed between the integrated first through hole and the first notch and the integrated second through hole and the second notch.

2. The set of claim 1, wherein the first through hole has a first diameter substantially the same as an inside diameter of the tubular body.

3. The set of claim 2, wherein the first notch has a first notch width substantially the same as a width of the connecting member when the first fastener is coupled with the second fastener.

4. The set of claim 1, wherein the assembly tool further comprises a storage case, wherein the storage case is connected to the body.

5. The set of claim 2, wherein the second through hole has a second diameter smaller or larger than the first diameter, or the second notch has a second notch width smaller or larger than the first notch width.

6. The set of claim 2 further comprising a second straw with an improved structure of a straw, wherein the improved structure of the straw, comprising:

a tubular body having a first end, a second end and openings, and each of the openings is formed at the first end and the second end, respectively; wherein the tubular body comprises: a tube wall, which is disposed between the first end and the second end; and a connecting member disposed at the tube wall, wherein a thickness of the connecting member is thicker than a thickness of the tube wall; wherein the connecting member comprises: a first fastener and a second fastener corresponding to the first fastener, and wherein the first fastener is coupled with the second fastener openably and closably;

the second through hole has a shape corresponding to an outer contour of the tubular body of the second straw; and the second notch has a shape corresponding to an outer contour of the connecting member of the second straw.

7. The set of claim 6, wherein the second through hole has a third second diameter smaller or larger than the first diameter, or the second notch has a second notch width smaller or larger than the first notch width.

8. The set of claim 7, wherein the assembly tool further comprises a third through hole, disposed through the body; wherein the third through hole is beside the first notch and integrates to the first notch; and a spacing part, disposed between the first through hole and the third through hole.

9. The set of claim 8, wherein the third through hole has a third diameter smaller or larger than the first diameter.

10. The set of claim 8 further comprising a second straw with an improved structure of a straw, wherein the improved structure of the straw, comprising:

a tubular body having a first end, a second end and openings, and each of the openings is formed at the first end and the second end, respectively; wherein the tubular body comprises: a tube wall, which is disposed between the first end and the second end; and a connecting member disposed at the tube wall, wherein a thickness of the connecting member is thicker than a thickness of the tube wall; wherein the connecting member comprises: a first fastener and a second fastener corresponding to the first fastener, and wherein the first fastener is coupled with the second fastener openably and closably;

the third through hole has a shape corresponding to an outer contour of the tubular body of the second straw; and the first notch has a shape corresponding to an outer contour of the connecting member of the second straw.

11. The set of claim 10, wherein the third through hole has a third diameter smaller or larger than the first diameter.

12. The set of claim 1, wherein a length of the connecting member substantially equals to a length of the tube wall.

13. The set of claim 1, wherein the tube wall has an inner surface and an outer surface corresponding to the inner surface, wherein one side of the connecting member next to the inner surface is configured to substantially align with the inner surface, so that the connecting member protrudes outwardly from the outer surface.

14. The set of claim 1, wherein the tubular body and the connecting member are formed in one piece.

15. The set of claim 1, wherein the tube wall has a first side and a second side corresponding to the first side, and wherein the first fastener is disposed at the first side and extends from the first end to the second end; and the second fastener is disposed at the second side and extends from the first end to the second end.

16. The set of claim 15, wherein the first fastener comprises a groove, and the groove is disposed at and along the first fastener; wherein the groove has a slit corresponding to the second fastener.

17. The set of claim 16, wherein the second fastener comprises a protruding member, the protruding member is disposed at and along the second fastener; wherein the protruding member is corresponding to the first fastener.

18. The set of claim 17, wherein the first fastener further comprises two auxiliary members, and each of the auxiliary members is disposed at each side of the slit along the first fastener; wherein each of the auxiliary members extends toward the second fastener.

19. The set of claim 18, wherein the protruding member comprises a first protruding part and a second protruding part, wherein the first protruding part is disposed along the second fastener and the second protruding part is disposed on the first protruding part along the second fastener, and wherein the first protruding part substantially corresponds to the auxiliary members and the second protruding part substantially corresponds to the groove.

20. The set of claim 19, wherein the second protruding part has an expanding part, wherein a width of the expanding part is larger than a width of the first protruding part.

21. The set of claim 20, wherein the width of the expanding part is not larger than a width of the connecting member.

22. The set of claim 20, wherein each of the two auxiliary member forms a curved structure extending from the inner surface and the outer surface of the tube wall, and a hook is formed at an outward end of each of the two auxiliary members and a hook point of the hook faces the groove.

23. The set of claim 22, wherein a spacing between the two hook points is smaller than the width of the expanding part but not smaller than the width of the first protruding part.

24. The set of claim 21, wherein each of the two auxiliary member forms a curved structure extending from the inner surface and the outer surface of the tube wall, and a hook is formed at an outward end of each of the two auxiliary members and a hook point of the hook faces the groove.

* * * * *